United States Patent [19]

Surakka et al.

[11] 4,259,180

[45] Mar. 31, 1981

[54] HYDROCYCLONE

[75] Inventors: Jorma Surakka; Matti Lankinen, both of Savonlinna, Finland

[73] Assignee: Enso-Gutzeit Osakeyhtio, Helsinki, Finland

[21] Appl. No.: 793,860

[22] Filed: May 4, 1977

[30] Foreign Application Priority Data

May 14, 1976 [FI] Finland ..... 761359

[51] Int. Cl.[3] ..... B04C 5/13

[52] U.S. Cl. ..... 209/211; 210/512.1

[58] Field of Search ..... 209/211, 144; 210/512 R

[56] References Cited

U.S. PATENT DOCUMENTS

| | | | |
|---|---|---|---|
| 3,288,300 | 11/1966 | Bouchillon | 209/211 X |
| 3,306,444 | 2/1967 | Troland | 209/211 |
| 3,494,474 | 2/1970 | Estabrook | 209/211 X |
| 3,613,887 | 10/1971 | Wikdahl | 209/211 |
| 3,724,674 | 4/1973 | Loison | 209/211 X |

*Primary Examiner*—Ralph J. Hill

*Attorney, Agent, or Firm*—Lewis H. Eslinger

[57] ABSTRACT

A hydrocyclone for dividing fiber suspensions into accept and reject fractions, said hydrocyclone being constituted by a conical separation chamber vertically positioned and having at its lower apex end an outlet aperture for the reject fraction, and a base part associated with the upper end of said separation chamber and provided with at least one inlet opening for the fiber suspension, an accept pipe being arranged coaxially with said separation chamber and said base and passing through the top of said base, said accept pipe having its lower inlet end at a level between said inlet opening for the fiber suspension and said outlet aperture for the reject fraction, and the outer surface of the accept pipe having the shape a truncated cone and being further provided with an annular projecting lip forming a discontinuity in said outer surface, the lower side of the lip, facing the reject outlet, having a curved concave shape in order to deflect part of the vortex impinging thereon back towards the reject outlet.

1 Claim, 1 Drawing Figure

HYDROCYCLONE

BACKGROUND OF THE INVENTION

1. Field of the Invention

The present invention relates to hydrocyclones in which liquid suspensions of solids, particularly fiber suspensions, can be divided into different fractions by using centrifugal force.

2. Description of the Prior Art

Hydrocyclones are commonly used in the cellulose and paper industry for separating pure fiber material from a fiber suspension which also contains harmful impurities and coarser particles which must be removed before the fiber suspension can be fed to the paper machine. A hydrocyclone comprises a separation chamber the base of which has been provided with a guide channel or channels for the liquid suspension which is to be fed in. This liquid suspension enters the separation chamber tangentially and travels from one end of the chamber to the other vertically. The apex of the separation chamber is open and the impurities which constitute the reject fraction are removed through it. The fiber suspension from which impurities have been removed is for its part removed through a pipe or channel in the base part of the separation chamber; the purpose of this pipe or channel is to receive an inner vortex produced in the separation chamber and containing the pure fiber fraction usable for paper pulp. The former fraction is called the reject fraction and the latter the accept fraction, and the respective parts in the separation chamber are called the reject end and the accept end.

The reason for the decrease in the classification efficency of a hydrocyclone is known to lie in the accept end, where counterflows are produced at the fiber suspension inlet; these flows travel along the outer surface of the accept-receiving pipe towards its inlet end, where a portion of the counterflows is drawn into the accept pipe and is removed along with the fraction usable for paper pulp before it has been possible for the hydrocyclone to separate the impurities which should pass into the reject fraction.

SUMMARY OF THE INVENTION

The present invention provides a hydrocyclone of the character once described, which comprises a conical separation chamber the apex of which has an outlet aperture for the discharge of the reject fraction; a base part arranged above and associated with the larger end of said conical separation chamber and provided with at least one inlet opening for the fiber suspension; an accept pipe passing through the top of the base part and positioned coaxially with the conical separation chamber, said accept pipe having its inlet mouth at a level between said inlet opening for the fiber suspension and said discharge aperture for the reject, the outer surface of the accept pipe having along a distance thereof beginning at the inlet end the shape of an expanding truncated cone; an annular lip being provided at and projecting from said truncated conical surface so that a discontinuity is formed therein, that side of the lip facing the reject outlet having a curved concave shape so that part of the vortex coming in the direction from the reject outlet towards the accept pipe mouth is deflected back towards the reject outlet.

It is an object of the present invention to eliminate the above mentioned disadvantage in known hydrocyclones by shaping the accept pipe in such a manner that impurity particles cannot pass into the accept fraction, the structure of the hydrocyclone being kept as simple as possible and advantageous in terms of flow technology.

The invention is based on the idea that the rotational velocity of the fiber suspension flowing downwards from the base increases near the accept-pipe surface when the radius of the rotational path decreases towards the inlet end of the accept pipe. This already promotes the separation, from the fiber suspension, of the reject fraction which mainly consists of impurities heavier than the fibers. The fiber suspension in the inner vortex, returning upwards from the reject end, partially passes the accept pipe inlet and continues traveling some distance towards the upper part of the base along the outer surface of the accept pipe, whereafter the flow direction of the fiber suspension is returned towards the reject end, in a direction parallel to the flow coming from the base, with the aid of a lip at the converging lower end of the accept pipe. This reversed flow, i.e., part of the accept flow, forms a "curtain" in front of the flow coming from the base, thereby preventing the impurities present in it from traveling, under the influence of the pressure difference in the radial direction, to the mouth of the accept pipe and from there along with the accept flow. The lip in the surface of the accept pipe at the same time serves as a discontinuity for the accept-pipe surface, in which case the flow coming along it from the base part can no longer follow the surface of the accept pipe but is turned in the radial direction away from the accept-pipe mouth while traveling downwards.

BRIEF DESCRIPTION OF THE DRAWING

The invention is described below in detail with reference to the enclosed drawing which shows, schematically, a longitudinal cross section of a hydrocyclone according to the most advantageous embodiment of the invention.

DESCRIPTION OF THE PREFERRED EMBODIMENT

Figure 1:
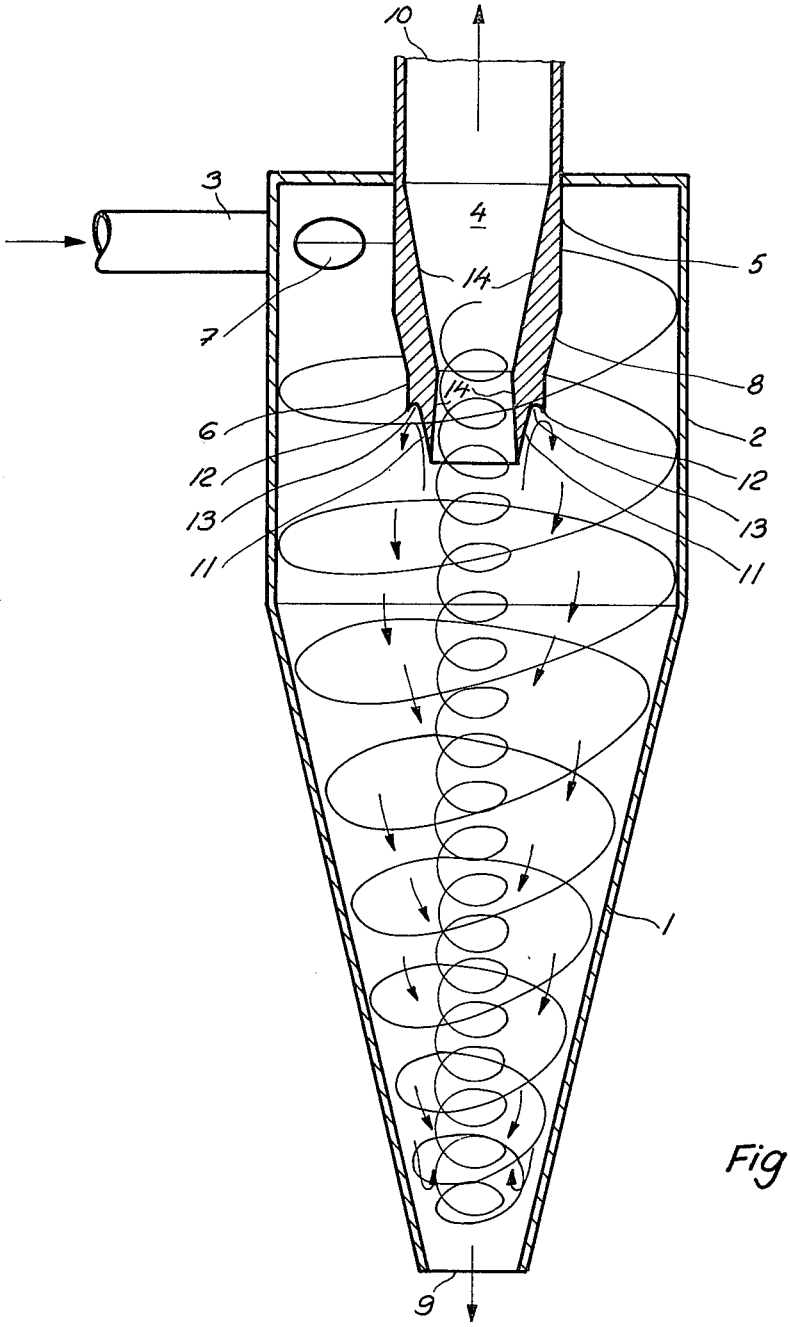

The hydrocyclone consists in the conventional manner of a conical separation chamber 1 which adjoins a cylindrical base part 2. The fiber suspension to be purified is fed tangentially into the hydrocyclone through a feed pipe 3 attached to the base part 2. A pipe 4 for withdrawing the accept has been fitted coaxially in the base part 2. The upper part 5 of the accept pipe 4, attached to the top of the hydrocyclone, is cylindrical at the inlet 7 and below it, whereafter follows a conical part 8. Thus the rotational radius of the flow coming from the base around the accept pipe surface is decreased and consequently the velocity of the flow, fed at a constant pressure, increases. This for its part increases the centrifugal force effecitve in the base part 2, and the impurities present in the feed flow, especially those which are heavier than the fibers, are flung towards the walls of the base part 2 and continue their travel along the walls, finally ending up in the reject outlet 9 of the separation chamber 1. The conical part 8 is continued by a small cylindrical part 6, which does not have a noteworthy increasing effect on the velocity but has in practice been found advantageous in terms of calming the flow. When the flow travels downwards along the walls of the separation chamber 1, the accept fraction containing fibers is separated from it. The accept fraction, being lighter, passes into the inner vortex in the middle of the hydrocyclone, this vortex extending from the reject fraction outlet 9 to the accept fraction outlet 10 in pipe 4. A portion of this accept flow is, however, directed onto the conical surface 11 of the lower part of the accept pipe 4. It travels upwards along this surface 11 until it reaches the lip 12, which returns the flow downwards, in a direction parallel to the flow which travels close to the surface of the base part 2. The lip 12 is formed in the surface of the lower part of the accept pipe 4 as follows: In its upper part the conical surface 11 changes into a downwards curving surface 13, which finally joins the cylindrical part 6. The radius of curvature of the curved surface 13 is such that the direction of the flow traveling along it changes into a direction parallel to the reject flow. Thus, in front of the reject flow a "curtain" is formed which prevents the impurities present in the flow coming from the base part 2 from passing in the radial direction towards the mouth of the accept pipe and from there along with the accept flow. Furthermore, as the lip 12 encircling the entire surface of the accept pipe 4 forms a discontinuity of the outer surface, the flow detaches from it with the consequence that there is a smaller chance that the impurities present in the flow pass into the accept flow. Thus a portion of the accept flow is brought along with the flow coming from the base 2 which travels in the ordinary manner into the conical separation part 1. In other words, a portion of the accept flow is circulated in the hydrocyclone, while the major portion of it is withdrawn along with the inner vortex into the accept pipe 4, the inner surface 14 of which first converges over some distance, whereafter it again widens when approaching the accept outlet 10.

The invention is not limited to the embodiment shown in the drawing but can be varied within the claims. Thus, the conical part 8 in the upper part of the accept pipe 4 can continue as far as the lip 12, without having a cylindrical part 6 between them. In addition, the lip 12 can curve outwards from the conical part 8 or the cylindrical part 6, in which case the flow coming from the base part 2 along the surface of the accept pipe 4 receives a radial velocity component. Because of this velocity component the flow passes even further away from the mouth of the accept pipe 4, and the chance of the impurities present in it ending up in the accept pipe is further decreased. It is also possible to make the surface of the accept pipe 4 as a cone extending as far as the lip, without a cylindrical part at the feed inlet 7. In the figure the hydrocyclone according to the invention has been provided with normal tangential feed. A hydrocyclone according to the invention can, however, also be provided with feed channels of the type disclosed in the U.S. patent application Ser. No. 735,094, filed on Oct. 22, 1976 now U.S. Pat. No. 4,067,814, in which case the operation becomes even more efficient. In practical experiments very good results have been achieved with such a combination, especially as regards splinters present in a fiber suspension.

What is claimed is:

1. A hydrocyclone for dividing a fiber suspension into accept and reject fractions, said hydrocyclone comprising: a generally conical separation chamber having an apex defining an outlet aperture for the discharge of the reject fraction; and a larger end located above said apex; a base part arranged above and associated with said larger end of said conical separation chamber communicating with at least one inlet opening for the fiber suspension; an accept pipe positioned in and extending through said base part and positioned coaxially with the conical separation chamber, said accept pipe having an inlet mouth located at a level between said inlet opening for the fiber suspension and said discharge aperture for the reject, said accept pipe having an outer surface along a distance thereof beginning at said inlet mouth which is in the general shape of an expanding truncated cone and having an annular lip formed therein and projecting from said truncated conical surface to define a discontinuity in said truncated conical surface, said lip having a curved concave shape facing the reject outlet whereby part of the vortex coming in the general direction from the reject outlet towards the accept mouth is guided and deflected along a portion of said truncated conical surface into said concave shape of the lip and back towards the reject outlet, while the truncated conical surface of the accept pipe decreases the rotational radius of the flow coming from the base part around the accept pipe increasing the centrifugal force effect in the base part; the outer surface of said lip having an essentially cylindrical shape and the inner side of said accept pipe having a first slightly converging zone beginning at the inlet mouth thereof and a second diverging zone associated with said first zone and leading to an outlet for the accept fraction; said truncated conical surface of the accept pipe having a generally cylindrical surface portion formed therein above said lip in the direction of flow of the accept portion to calm the flow of material around the lip.

* * * * *